US005249816A

United States Patent [19]

Southworth

[11] Patent Number: 5,249,816

[45] Date of Patent: Oct. 5, 1993

[54] SKI BOARD

[75] Inventor: Michael J. Southworth, Mesa, Ariz.

[73] Assignee: Power Sport Research Corp., Mesa, Ariz.

[21] Appl. No.: 979,768

[22] Filed: Nov. 20, 1992

[51] Int. Cl.[5] ..... A63C 17/18

[52] U.S. Cl. ..... 280/14.2; 280/16

[58] Field of Search ..... 280/14.2, 16, 87.042, 280/15, 21.1, 22.1

[56] References Cited

U.S. PATENT DOCUMENTS

| | | | |
|---|---|---|---|
| 3,030,123 | 4/1962 | Dworak | 280/14.2 |
| 4,116,455 | 9/1978 | Dotson et al. | 280/14.2 X |
| 4,138,128 | 2/1979 | Criss | 280/16 |
| 4,161,324 | 7/1979 | Colvin | 280/16 X |
| 4,221,394 | 9/1980 | Campbell | 280/14.2 |

*Primary Examiner*—Margaret A. Focarino
*Assistant Examiner*—Michael Mar
*Attorney, Agent, or Firm*—James D. Givnan, Jr.

[57] ABSTRACT

A ski board provided with a front and rear ski is disclosed with the skis steerable through resilient coupling assemblies for each ski. A cantilever projects downwardly and forwardly from a mid-point on the ski board platform and serves to carry the front ski. H-shaped brackets connect each of the coupling assemblies to their respective ski. A bridle is attached to the cantilever to receive a tow rope and permits towing of the ski board over a variety of surfaces including sand without hindering board maneuverability.

6 Claims, 1 Drawing Sheet

5
4
3
1
2
41
3
3
1A
37
26
12
10
14
6
9
8

6
8
5
4
2
3
1
1A
9

41
11
40
22
20
16
4
4
8
10
20
40
22
11
41

35
27
30
28
1A
34
B
33
31
26
36
32

16
24
23
15
A
10
14
20
17
19
18

8
8A
8A

SKI BOARD

BACKGROUND OF THE INVENTION

The present invention relates generally to ski board construction.

In the last few years the sport of ski boarding has experienced a rapid rise in popularity. Ski boards typically include a single platform wide enough to permit the user's feet to be angularly disposed on the board in a fore and aft manner. Turning forces are imparted to the board by leaning toward one side or the other of the board. Holders or bindings are provided on the board to accomodate the user's footwear. Typical snow boards in use are intended for direct contact with the snow surface. Considerable skill is required especially to execute short radius turns.

Of collateral interest are skate boards which are equipped with front and rear trucks each including a resilient component to permit steering of the trucks by rocking of the skate board about its longitudinal axis.

In the prior art, U.S. Pat. No. 4,138,128 discloses a ski board having a platform supported by front and rear skis coupled to one another at their respective tail and nose by a resilient coupling. The fore and aft portions of the ski board are coupled to the front and rear skis respectfully by couplings which permit angular movement of the skis in response to lateral rocking of the platform. The coupling attaching the tail of one ski to the nose of the other includes a resilient member and serves to limit pivotal movement of the skis about horizontal and vertical axes to limit the range of ski travel. A toe rope is attached to the forward edge of the board or platform.

SUMMARY OF THE PRESENT INVENTION

The present invention is embodied within a ski board having independent fore and aft skis with the forward ski carried in cantilever fashion.

The present ski board includes a platform with holders for reception of the user's feet in a generally transverse position. In place on the underside of the present ski board is a cantilever or arm having a base attached to the board underside at a point intermediate the foot holders. The cantilever projects from said base and has a forward end equipped with a coupling assembly which permits steering of a front ski about a verticle axis. A frame of H-shape in place on the forward ski includes a cross member which serves as part of the resilient coupling assembly. Similarly, a rear ski includes a like frame having a cross member which constitutes part of a rear coupling assembly. Both coupling assemblies translate rolling motion of the ski board about its longitudinal axis into movement of the skis in opposite directions about separate verticle axes. The ski attached frames include longitudinal members for attachment lengthwise of the ski. Provision is made for attaching a tow bridle to a cantilever of the present ski board at a point near the boards center of gravity which is intermediate the foot holders to permit towing of the board over a variety of surfaces such as snow, water and sand in a stable manner as opposed to attachment of a tow rope to a platform front end.

Important objectives of the present ski board include the provision of a ski board having fore and aft skis with the forward ski supported in place by a cantilever provided at its distal end with a resilient coupling permitting steering of the ski; the provision of a ski board in which a cantilever is provided with an attachment point for a tow rope to the cantilever at a point near the board center of gravity to permit board use on a variety of surfaces including vehicular towing of same on sand.

DETAILED DESCRIPTION OF THE PREFERRED EMBODIMENTS

Figure 1:
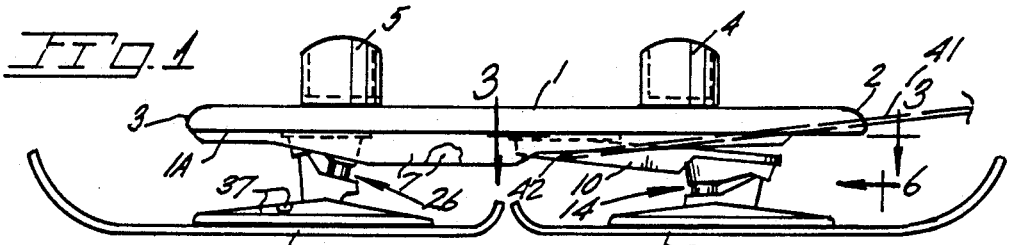
FIG. 1 is a side elevational view of the present ski board.
Figure 2:
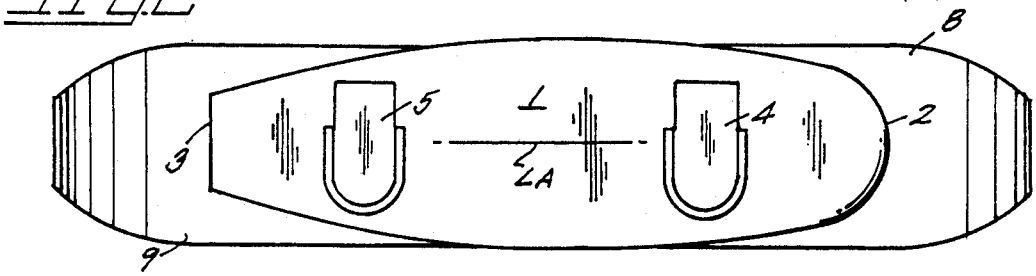
FIG. 2 is a plan view of FIG. 1.
Figure 3:
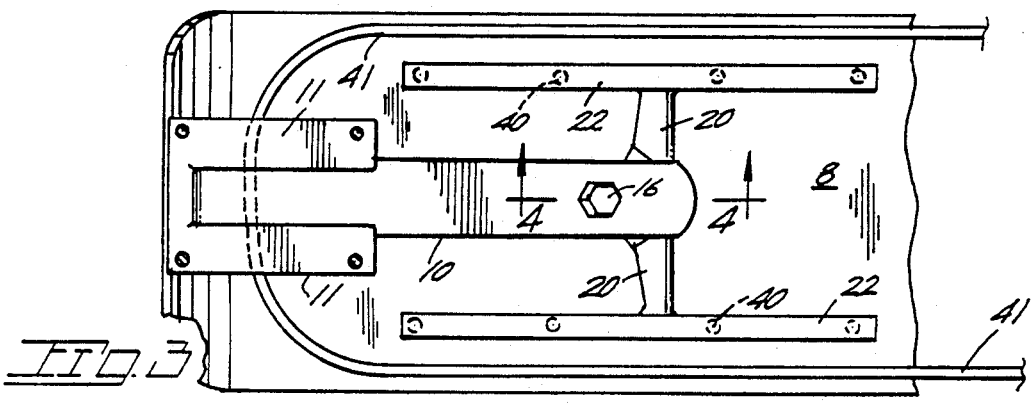
FIG. 3 is a horizontal sectional view taken along line 3—3 of FIG. 1.
Figure 5:
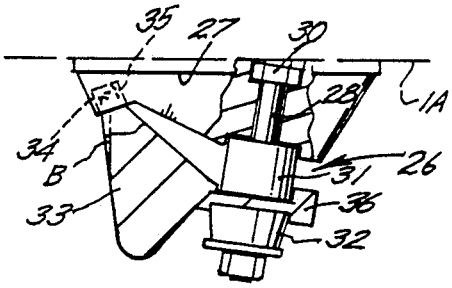
FIG. 5 is the view similar to FIG. 4 but showing a rear coupling assembly associated with the rear ski of the ski board.
Figure 4:
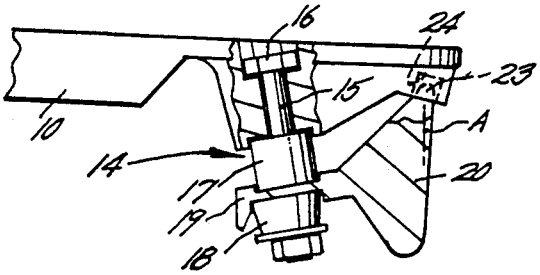
FIG. 4 is a vertical sectional view taken along line 4—4 of FIG. 3 and showing a cantilever fragment and a coupling assembly.

With continuing attention to the drawings wherein applied reference numerals indicate parts similarly hereinafter identified, the reference numeral 1 indicates an elongate platform of the present ski board having a curved forward end 2 and a trailing end 3.

Fore and aft foot holders are at 4 and 5 and may be equipped with suitable straps or binding components (not shown) for retention of the user's feet. A longitudinal board axis is at LA. A bottom surface 1A of the board may include integral stringers at 7. Front and rear skis are at 8 and 9.

A cantilever 10 projects forwardly in a downwardly inclined manner from its base 11 secured as by fasteners to the board bottom surface 1A intermediate foot holders 4 and 5. The cantilever or arm 10 may be of channel section. The distal end of the cantilever serves to carry a first resilient coupling assembly generally at 14 which includes a retainer 15 shown as a bolt assembly having a head 16 confined in a hexagonal recess with the bolt shank projecting downwardly through the distal end of the cantilever to receive resilient grommets or bushings 17-18 above and below a flange 19 of a bracket cross member 20. Cross member 20 is a component of an H-shaped bracket which additionally includes fore and aft orientated members 22. Cross member 20 has a centrally disposed apex 23 which is confined within a socket 24, in the distal end of the cantilever, in a loose manner permitting limited universal movement of cross member 20. Movement about a vertical axis A is imparted to the cross member and hence forward ski 8 upon rocking of the ski board and cantilever 10 to swing flange 19 about axis A with retainer 15 and the grommets subsequently returning the ski 8 to a neutral position.

A second coupling assembly is indicated generally at 26 and includes a base plate 27 secured to the underside of board 1. The second coupling assembly is reversed from coupling assembly 14. A retainer 28 shown as a bolt assembly includes a head 30 received within a hexagonal recess in the base plate with the retainer shank extending through grommets or bushings 31 and 32 both of a resilient material. A cross member 33 of a rear bracket includes an apex 34 which projects upwardly into a socket 35 in base plate 27 in a loose manner. Cross member 33 has a forwardly directed flange 36 which is apertured to receive the shank of retainer 28. Bracket cross member 33 terminates at its end in longitudinally orientated bracket members 37 to comprise a rear bracket similar to the earlier described bracket associated with the forward ski. Both of the front bracket and the rear bracket are secured to their respective skis by threaded fasteners 40.

Movement of board 1 about its longitudinal axis will impart opposite movement to cross member 20 and 33 about vertical axes A and B to impart steering movement to the skis. In both coupling assemblies 14 and 26 the cross members 20 and 33 automatically return to a neutral position, upon board 1 being parallel to a ground surface, to locate their respective skis parallel to the board axis by the action of the resilient bushings and the retainers extending therethrough.

Figure 6:
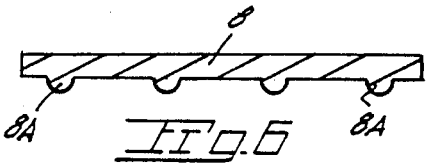
FIG. 6 is a verticle sectional view taken along line 6—6 of FIG. 1 to show a ski cross section.

In FIG. 6, a section of one of the skis is typical of most skis in that multiple parallel ridges 8A are provided on the ski bottoms to minimize skidding of the skis during turning of the ski board. The skis are preferably formed from an abrasion resilient high density synthetic plastic to permit use on a variety of ground surfaces including snow, sand, grass and water. The cantilever provides shock absorption as it is attached to the board at a point intermediate the front and rear foot holders and permits flexure of the board portion forward of the cantilever base. The forward coupling assembly, generally at 14, and the cantilever provide additional shock absorption.

Adjustment of the retainers 15 and 27 of the coupling assemblies by their nut elements to vary grommet compression will alter the steering action of the front and rear coupling assemblies.

A bridle at 41 is attached to cantilever 10 at a point 42 intermediate the foot holders 5 and 6 and near the ski board center of gravity midway between the holders. Use of the cantilever permits the bridle attachment point to be located near the board center of gravity located intermediate the foot holders. The bridle receives a tow rope (not shown) pulled by a vehicle, that type determined by the surface on which the ski board is being used. Accordingly, control of the ski board attitude or pitch is maintained by the fore and aft shifting of the rider's weight.

While I have shown but one embodiment of the invention, it will be apparent to those skilled in the art that the invention may be embodied still otherwise without departing from the spirit and scope of the invention.

Having thus described the invention, what is claimed and desired to be secured by a Letters Patent is:

1. A ski board having, an elongate platform including a pair of longitudinally spaced foot holders for reception of the user's feet, a steerable front ski and a steerable rear ski offset below said platform, a cantilever attached to the underside of said platform and disposed in a fore and aft inclined relationship to the platform, said cantilever having an elongage linear configuration, said cantilever including a base portion at a rearward end thereof, said base portion being attached to the underside of the platform at a center portion thereof midway between said foot holders, a first coupling assembly carried by the forward end of said cantilever including a front bracket attached to the front ski, a universal connection between said bracket and the forward end of said cantilever, first resilient means offset from said connection and urging said bracket and the front ski toward a predetermined relationship with said cantilever about said universal connection, lateral displacement of said first resilient means imparting movement to said front ski, a second coupling assembly carried at a rearward location on the underside of said platform and including a rear bracket attached to the rear ski, a rear universal connection, second resilient means offset from said rear connection and urging said bracket and said rear ski toward a predetermined relationship with the platform, lateral displacement of said second resilient means imparting movement to said rear ski, and a bridle attached to the cantilever proximate said base portion for receiving a tow rope.

2. The ski board claimed in claim 1 wherein said bridle is attached to said cantilever at a point intermediate said holders.

3. The ski board claimed in claim 1 wherein said front bracket and said rear bracket are of H-shape in plan view with parallel members longitudinally disposed on their respective ski.

4. The ski board claimed in claim 1 wherein said platform is of flexible construction and may flex in response to loads imparted by the front ski and cantilever during travel over irregular surfaces.

5. The ski board claimed in claim 1 wherein said front ski and said rear ski each have lengthwise orientated ridges to inhibit skidding.

6. A ski board for use on a variety of surfaces including snow, water and sand, said board comprising, a platform of elongate shape with a pair of spaced apart foot holders located in fore and aft positions along a major longitudinal axis of the platform, a steerable front ski and a steerable rear ski below said platform, a cantilever attached to the underside of said platform and disposed in a fore and aft inclined relationship to the platform, said cantilever having an elongate linear configuration, said cantilever having a base portion at a rearward end thereof, said base portion being attached to the platform and said cantilever extending forwardly and downwardly and having a forward end, said base portion being located at a center portion of the platform intermediate vertical planes containing said foot holders, a bridle for attachment to a tow rope, means on said cantilever located proximate said base portion of the cantilever and attaching the bridle to the cantilever for imparting tow rope applied forces to the cantilever and to the platform intermediate said vertical planes and proximate a center of gravity of the board, and coupling assemblies one each attaching the front ski to said forward end of said cantilever and the rear ski to said platform for imparting steering movement to each ski upon lateral displacement of said platform.

* * * * *